US005617743A

United States Patent [19]

Rednour

[11] Patent Number: 5,617,743

[45] Date of Patent: Apr. 8, 1997

[54] APPARATUS FOR KNITTING ABOUT A TRAVELING STRAND

[76] Inventor: Raymond J. Rednour, 5717 S. York Rd., Gastonia, N.C. 28052

[21] Appl. No.: 613,591

[22] Filed: Mar. 12, 1996

Related U.S. Application Data

[63] Continuation-in-part of Ser. No. 298,206, Aug. 29, 1994, abandoned.

[51] Int. Cl.[6] ..... D04B 9/44

[52] U.S. Cl. ..... 66/9 A

[58] Field of Search ..... 66/9 A, 8

[56] References Cited

U.S. PATENT DOCUMENTS

| | | | |
|---|---|---|---|
| 630,784 | 8/1899 | Stevens . | |
| 648,347 | 4/1900 | Wardall | 66/9 A |
| 1,514,499 | 11/1924 | Berdon | 66/9 A |
| 1,814,324 | 7/1931 | Meiwald | 60/9 A |
| 2,108,705 | 2/1938 | Broadwin | 66/9 A |
| 2,222,288 | 11/1940 | Ford | 66/9 A X |
| 2,261,349 | 11/1941 | Edelman | 66/9 A |
| 2,656,690 | 10/1953 | Buxbaum et al. | 66/9 A X |
| 3,418,830 | 12/1968 | Nestel | 66/9 A |
| 3,911,698 | 10/1975 | Walford | 66/84 S |
| 4,233,825 | 11/1980 | Glaspie | 66/125 A |

FOREIGN PATENT DOCUMENTS

| | | | |
|---|---|---|---|
| 111393 | 7/1876 | France | 66/9 A |
| 32530 | 1/1885 | Germany | 66/9 A |

*Primary Examiner*—John J. Calvert
*Attorney, Agent, or Firm*—Shefte, Pinckney & Sawyer

[57] ABSTRACT

An apparatus for knitting about a traveling strand includes a rotatable base, an arrangement for supporting a yarn package rotatably mounted to the base for rotation independently of the rotation of the base, a strand conduit, an arrangement for moving a strand through the strand conduit and a knitting assembly disposed along the strand conduit for knitting yarn supplied from the yarn package about the traveling strand.

15 Claims, 5 Drawing Sheets

APPARATUS FOR KNITTING ABOUT A TRAVELING STRAND

CROSS-REFERENCE TO RELATED APPLICATION

The present application is a continuation-in-part of U.S. patent application Ser. No. 08/298,206 filed Aug. 29, 1994 abandoned for APPARATUS FOR KNITTING ABOUT A TRAVELING STRAND.

BACKGROUND OF THE INVENTION

The present invention relates broadly to specialty knitting apparatus and, more specifically, to an apparatus for knitting a predetermined knitted pattern about a traveling strand.

Many decorative items, such as braided rugs or waste containers, can be made from a rope-like strand coiled about itself and fixed tightly to itself. Typically, the strand for forming the rug or other item has a yarn-like sheath knitted thereabout for the full length of the strand. The sheath may totally cover the strand or may be an open knit, revealing the surface of the strand. If the strand is a rope, the sheath can prevent unraveling as well as providing a decorative appearance. Further, cloth may be disposed intermediate the sheath and the strand to enhance the decorative appearance.

In the past, the sheath was hand-knitted to form the decorative cord. Attendant to this method are typical problems associated with hand-working a textile item. The process is time-consuming, labor-intensive and typically results in a less than uniform appearance. Accordingly, there exists a need to automate the sheath knitting function to provide a uniform cord in sufficient quantity for manufacturing without the problems associated with hand knitting.

SUMMARY OF THE INVENTION

It is accordingly an object of the present invention to provide an apparatus for automatically knitting a sheath around a decorative cord or strand to automate the previously labor-intensive knitting operation.

It is further an object of the present invention to provide such an apparatus for knitting about a traveling strand which requires little user interference.

It is another object of the present invention to provide such an apparatus which can be used to dispose decorative textile material intermediate the sheath and the inner cord.

To that end, an apparatus for knitting about a traveling strand includes a rotatable base member mounted to a support and an arrangement for rotating the base member. An assembly for supporting a yarn package is rotatably mounted to the base member for rotation independently from rotation of the base member. A strand conduit is mounted to the support concentrically with respect to said means for supporting a yarn package and an assembly for moving a strand through the strand conduit is also mounted to the support. A knitting assembly is disposed adjacent the strand conduit for receiving yarn from a yarn package supported on the yarn package support arrangement and knitting the yarn about a strand traveling through the strand conduit with the knitting arrangement being operable responsive to rotation of the base member. Since the yarn package support arrangement is freely rotatable independently from rotation of the base member, yarn may be supplied to the knitting assembly at a rate determined by demand from the knitting assembly.

Preferably, the knitting assembly includes a plurality of knitting needles slidably mounted to the strand conduit and the base member includes at least one cam lobe disposed thereon for reciprocally driving the knitting needles as the base member is rotated.

The strand conduit preferably includes an elongate inner tube having the knitting needles slidably mountable thereto with the tube being mounted to the support for rotation of the base member thereabout, and an elongate outer tube for suporting the second arm which rotates with the base.

It is preferred that the yarn package support assembly includes a rotatable platform freely rotatably mounted to the base member for rotation about the strand tube independently of rotation of the base member.

The present invention further preferably includes an assembly for directing yarn from the yarn package to the knitting assembly. The yarn directing assembly includes a first arm having a yarn opening formed in a distal end thereof mounted to the base for rotation therewith and projecting therefrom for maintaining yarn from the yarn package substantially taut during knitting operations. A second arm is mounted to the strand conduit for directing the yarn into said kintting assembly and for maintaining tension on the yarn cooperatively with the first arm, with the second arm having an opening in the distal end thereof for the passage of yarn therethrough. The first and second arms are mounted in alignment for the linear alignment of said yarn passing therethrough.

It is preferred that the strand moving assembly include an arrangement for drawing the strand at a predetermined rate, the draw rate being proportional to the rotational rate of the base member. Preferably, the drawing assembly includes two adjacent cylinders selectively counter-rotatably driven for driving a strand disposed therebetween. Further, the cylinders each preferably include a traction surface thereon having a relatively high coefficient of friction.

In order to enhance the decorative nature of cord produced by the present invention, the present invention allows the user to dispose a textile material intermediate the knitted yarn and the traveling strand. To that end, an arrangement for directing textile material to a disposition for being fixed intermediate the strand and the knitted yarn when the yarn is knitted about the strand is provided. The directing arrangement preferably includes a funnel for selective positioning generally concentrically about the strand at a position in advance of the knitting assembly with respect to the direction of strand movement for feeding textile material thereinto for positioning the textile material adjacent the strand for knitting the yarn about the strand with the textile material intermediate the strand and the knitted yarn.

By the above, the present invention provides a simple, automated device for producing decorative cords by knitting a yarn about a moving strand. Optionally, decorative textile material may be positioned intermediate the yarn and the strand.

DETAILED DESCRIPTION OF THE PREFERRED EMBODIMENT

Figure 1:
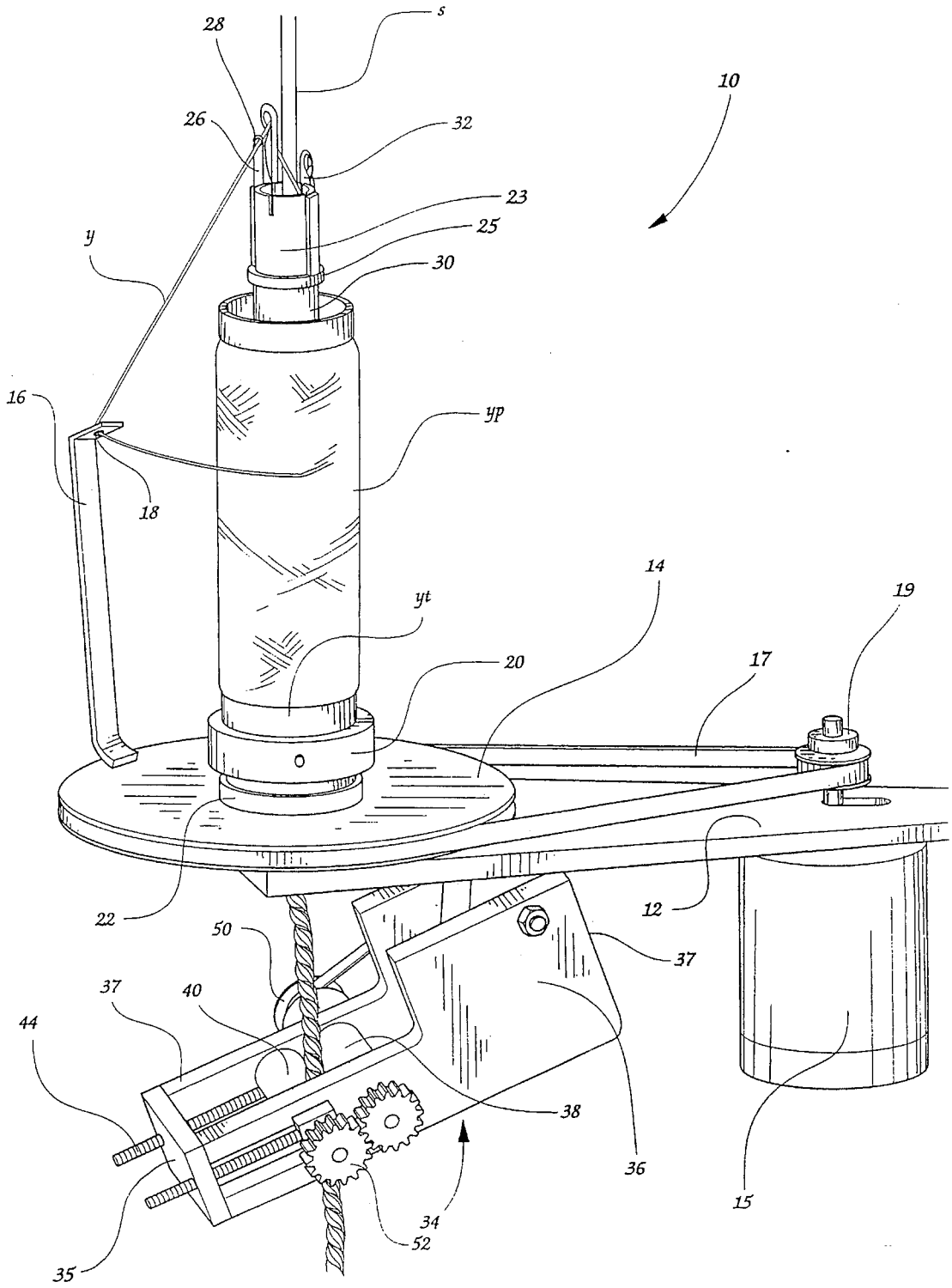
FIG. 1 is a perspective view of an apparatus for knitting about a traveling strand according to the preferred embodiment of the present invention.

Turning now to the drawings and, more particularly, to FIG. 1, an apparatus for knitting about a traveling strand is illustrated generally at 10 with the primary components mounted to a generally planar support member 12. A base 14 is formed as a generally flat, round member and is rotatably mounted to the support 12 for being rotatably driven with respect to the support 12. An electric motor 15 is mounted to the support for driving the base 14 using a conventional belt 17 which is trained around a drive pulley 19 attached to the motor 15 and the perimeter of the base 14. As will be seen, rotation of the base 14 controls the knitting operation of the present invention. A generally elongate, planar first yarn directing arm 16 is mounted to the upper surface of the base 14 for rotation therewith. The yarn directing arm 16 projects outwardly and generally upwardly from the base 14 and includes a yarn guide opening 18 formed in the distal end thereof. As will be seen, the yarn directing arm 16 rotates with the base 14 to position the yarn for access by knitting needles.

Figure 2:
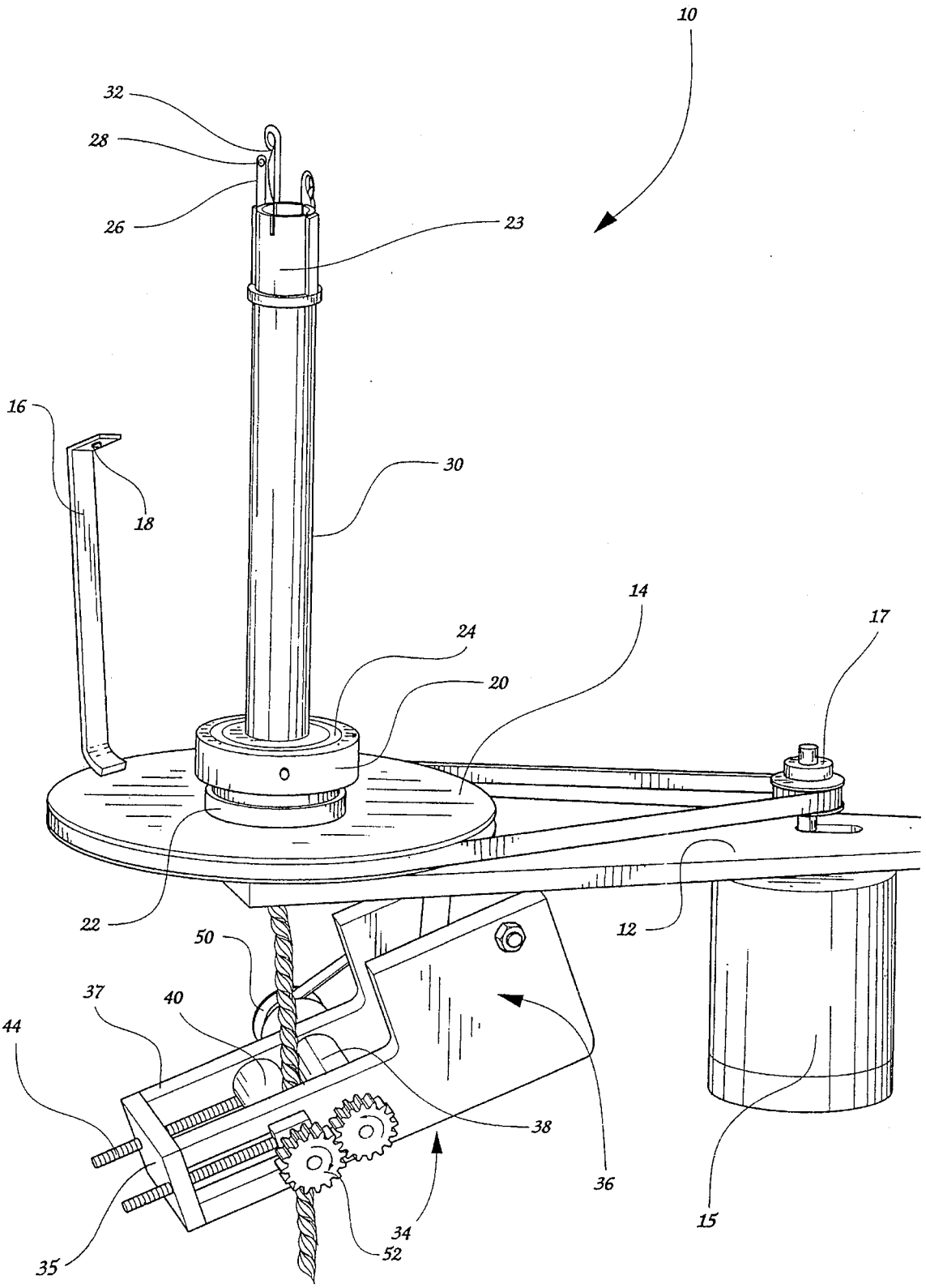
FIG. 2 is a perspective view of the apparatus illustrated in FIG. 1 with the yarn supply and core strand removed.

The yarn supply for the present invention is in the form of a yarn package YP or bobbin mounted to a bobbin support member 20 which is rotatably mounted to a bobbin support member base 22 which is fixedly mounted to the base member 14. As seen in FIG. 2, a locator groove 24 is formed in the bobbin support member 20 to receive a portion of the yarn tube YT therein. The groove 24 aids in the positioning and stabilization of a yarn package YP on the bobbin support member 20. The bobbin support member 20 is rotatably mounted to its base 22 for free rotation thereon, independently of the rotation of the base member 14. The function of this will be explained in greater detail hereinafter.

With continued reference to FIG. 2, an elongate strand conduit 30, in the form of a tube, is mounted to the support 12 and projects upwardly, generally concentrically, through the base 14, the bobbin support member base 22 and the bobbin support member 20 for a predetermined distance, and for rotation with the platform 14. An inner needle support conduit 23 is slidably mounted concentrically within the strand conduit 30, with the strand conduit 30 rotatable thereabout. The length of the needle support conduit 23 is not critical, yet it must be longer than the yarn tube YT. As seen in FIG. 1, the strand S may be passed through the needle support conduit 23, and, as a direct result, the strand conduit 30, to emerge therefrom below the support 12. It should be noted that due to the concentric nature of the strand conduit 30 and the needle support conduit 23, any references herein to passage of the strand through the strand conduit 30 shall be understood to mean that the strand passes through both conduits 23, 30. Further, it will be appreciated that as the strand conduit 30 rotates with the platform 14, the needle support conduit 26 remains fixed in position.

A plurality of knitting needles 32, formed as generally conventional latch needles, are slidably disposed in grooves (not shown) formed in the needle support conduit 23 for reciprocal movement therein. A needle support collar 25 encircles the strand conduit 30 for support of the needles 32. FIG. 2 illustrates two needles 32 disposed in spaced opposition across the entrance to the needle support conduit 23. However, it should be noted that any number of needles may be used to provide any number of knitted patterns with the number of needles being limited only by the circumferential area of the strand conduit 30. The needles are driven in knitting operation by a cam lobe (not shown) disposed on the strand conduit 30 underneath the collar 25. The cam lobe rotates beneath the needles 32 and drives them in a reciprocating motion. Cam-driven knitting needles are generally known and this type of needle movement may be readily achieved by those skilled in the art.

In order to present the yarn Y to the needles 32 in proper alignment and to maintain proper yarn tension, a second yarn directing arm 26 is mounted to the strand conduit 30 and projects upwardly therefrom adjacent the needles 32. The second yarn directing arm includes a yarn directing eyelet 28 formed in the distal end thereof for passage of yarn therethrough. The second yarn directing arm 26 is mounted in alignment with the first yarn directing arm 16 and maintains that alignment throughout rotation of the rotating elements of the apparatus. Therefor yarn extending form the first yarn directing arm 16 to the second yarn directing arm 26 is maintained taut and straight as it is presented to the needles 32.

Figure 4:
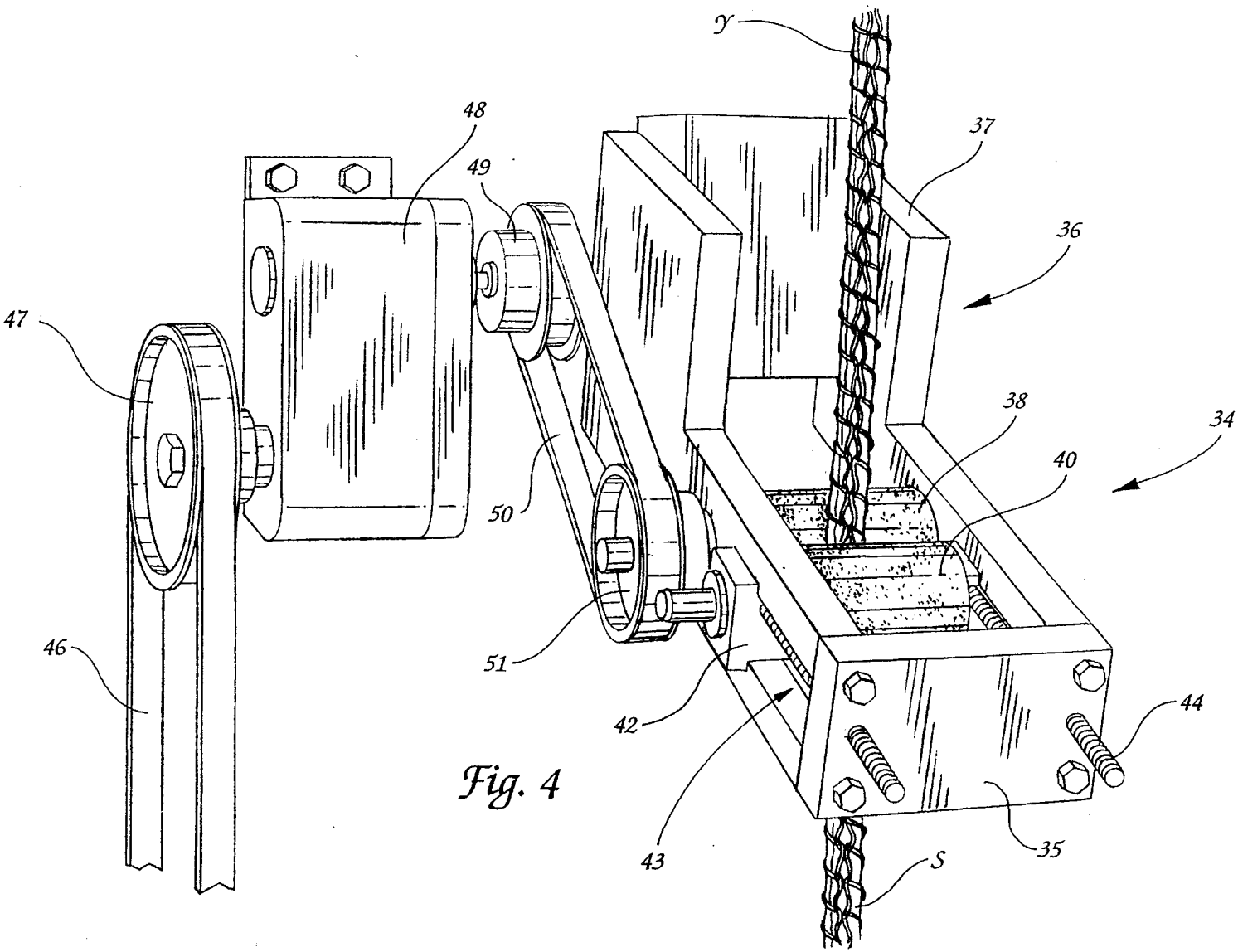
FIG. 4 is a perspective view of the strand drawing apparatus of the present invention.

In order to coordinate movement of the strand S through the conduit 30 in time with the needle motion, a strand drawing assembly 34 is provided. As seen in FIGS. 1 and 2, the strand drawing assembly 34 is mounted to the support 12 beneath the base 14. With reference to FIG. 4, it can be seen that the strand drawing assembly 34 includes a frame 36 including two generally L-shaped members 37 mounted in a spaced opposing configuration with each L-shaped member 37 having a slot 43 formed therein and joined by an end plate 35. Two strand drawing cylinders 38, 40 are mounted intermediate the L-shaped members 37 and are configured for being driven in a counter-rotational manner. A first cylinder 38 is rotatably mounted to the L-shaped member 37 while the second cylinder is adjustably mounted to a mounting block 42 which is slidably disposed in the slot 43. A pair of generally elongate threaded members 44 project from the mounting block 42 outwardly through the end plate 35 so that rotational adjustment of the threaded members 44 moves the second cylinder 40 inwardly or outwardly within the slot 43 to increase or decrease the distance between the two cylinders 38, 40. Both cylinders 38, 40 have a roughened or textured surface to provide enhanced traction when engaging and drawing the strand S.

The first cylinder 38 is driven in a first rotational direction by a drive belt 50 trained around two pulley members 49, 51. The driving pulley member 49 is connected to a reduction gear box 48 which is in turn driven by a belt 46 trained around a drive pulley 47 which is driven from a central power source (not shown). As best seen in FIGS. 1 and 2, a pair of intermeshed gears 52 is mounted each to a cylinder 38, 40 so that as the first cylinder 38 is driven in a first rotational direction, the second cylinder 40 is driven in the opposite rotational direction as indicated by arrows in FIG. 2. As seen in FIGS. 1 and 4, the strand S is directed intermediate the two cylinders 38, 40 and the threaded members 44 are used to tighten the second cylinder 40 against the first cylinder 38 so that, when the strand drawing assembly 34 is activated, the oppositely turning cylinders engage and draw the strand S therebetween at a predetermined rate. As will be seen, this rate is coordinated with the rotational rate of the base 14. It should be understood that the strand drawing assembly 34 is powered independently from the base 14.

Figure 3:
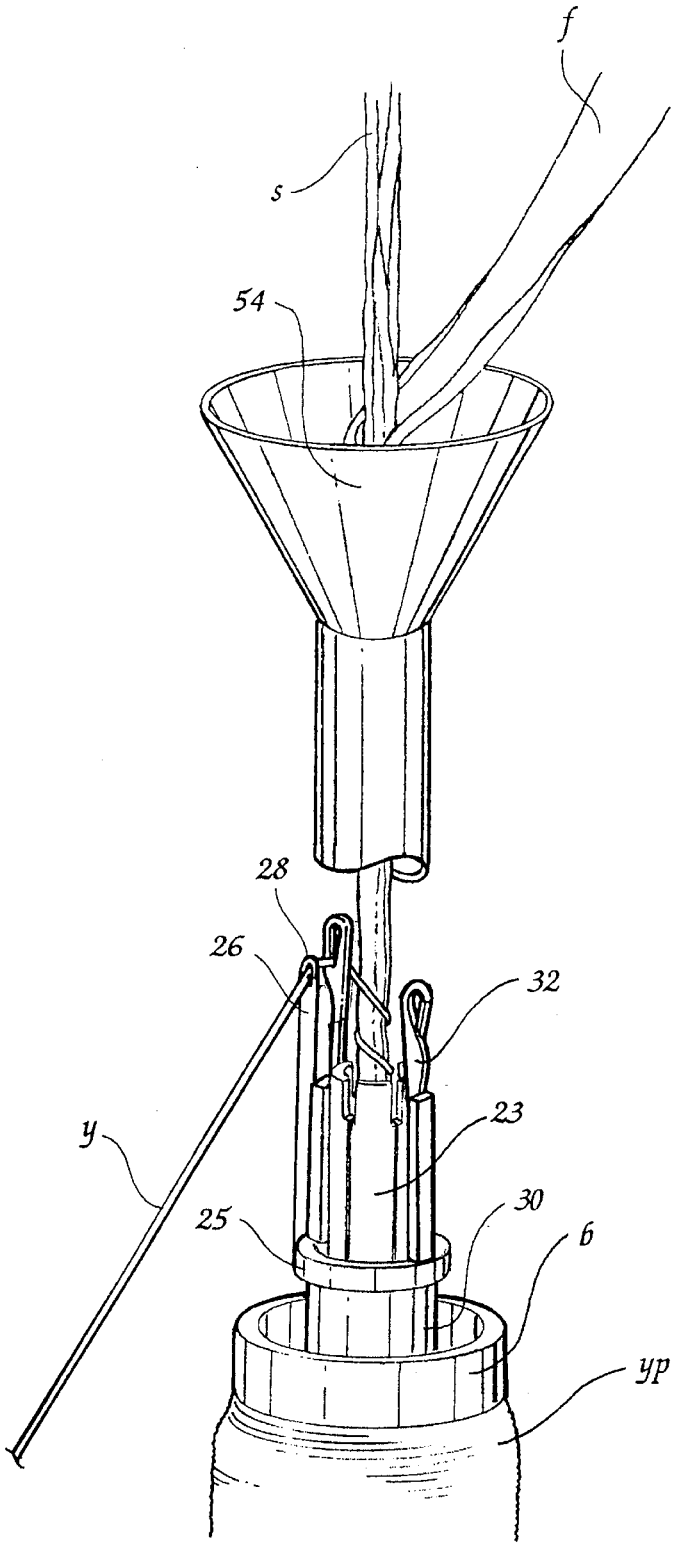
FIG. 3 is an elevational view of the textile material directing assembly illustrating its association with the knitting assembly of the present invention.

Optionally, and as previously mentioned, a layer of textile material or fabric may be disposed intermediate the yarn Y and the strand S to add enhanced decoration to the finished cord. To that end, and with reference to FIG. 3, a funnel 54 is provided and is positionable above the knitting needles 32. The textile fabric F is fed into the funnel cone along with the strand S which is fed directly through the funnel. The convergence of the walls of the cone acts to converge the strand and the fabric so that each is in abutment with the other as the strand enters the knitting region of the apparatus as defined by the presence of the knitting needles 32. As a further option, additional yarn packages (not shown) may be disposed adjacent the apparatus, mounted in a freely rotatable manner. Yarn from the additional yarn packages may be directed through the yarn directing opening 18 in the first yarn directing arm 16 to the knitting needles 32 for knitting a denser pattern or using different colored or textured yarn or both to enhance the decorative appearance of the finished product.

In operation, and with reference to FIG. 1, a yarn package YP disposed on a yarn tube YT is positioned concentrically with the strand conduit 30 and fitted to the bobbin support member 20 with the yarn tube YT projecting into the groove 24 for being retained therein. A strand S of core material is fed through the strand conduit 30 to emerge therefrom under the support 12. At this point, the drawing cylinders 38, 40 should be sufficiently spaced from one another to allow the strand S to be directed therebetween. Once the strand S is positioned therebetween, the threaded members 44 are engaged and rotated to progressively decrease the distance between the cylinders 38, 40 until the cylinders 38, 40 are closely adjacent with one another and in contact with the strand S sufficiently so that counter-rotation thereof will act to draw the strand S through the nip created by the cylinders 38, 40.

Next, a length of yarn Y is drawn from the yarn package YP and directed through the opening 18 formed in the first yarn directing arm 16, through the eyelet 28 formed in the second yarn directing arm 26, and then fed to a position adjacent the knitting needles 32 for lacing thereof, in a manner conventional to knitting machines with latch needles. Once the needles are threaded, operation of the apparatus can commence.

To commence knitting operation, the drive motor (not shown) for the yarn drawing assembly 34 is activated which causes the counter-rotating cylinders 38, 40 to draw the strand S downwardly therebetween. The motor 15 is then activated to commence rotation of the base 14. This causes the first and second yarn directing arms 16, 26 to rotate with the base 14 and the reciprocating movement of the knitting needles 32 to commence. The speed of the drawing assembly 34 is coordinated with the rotational speed of the base 14 to achieve the desired knitted pattern. As may be appreciated, the "openness" of the knitted pattern may be affected by the relative speed of the strand drawing assembly 34 and the rotating base 14. For example, to increase the openness of the knitted pattern, the speed of the strand drawing assembly 34 is increased relative to the rotational speed of the base member 14 and, therefore, the knitting speed. For a more closed pattern, the strand is drawn more slowly by the drawing assembly when compared to the rotational speed of the base 14. The overall effect on the strand is subtle, and it will be appreciated by those skilled in the knitting art that cahnges in the knitted pattern will be more pronounced whin the number of needles is changed or the needle driving cam is changed.

Figure 5:
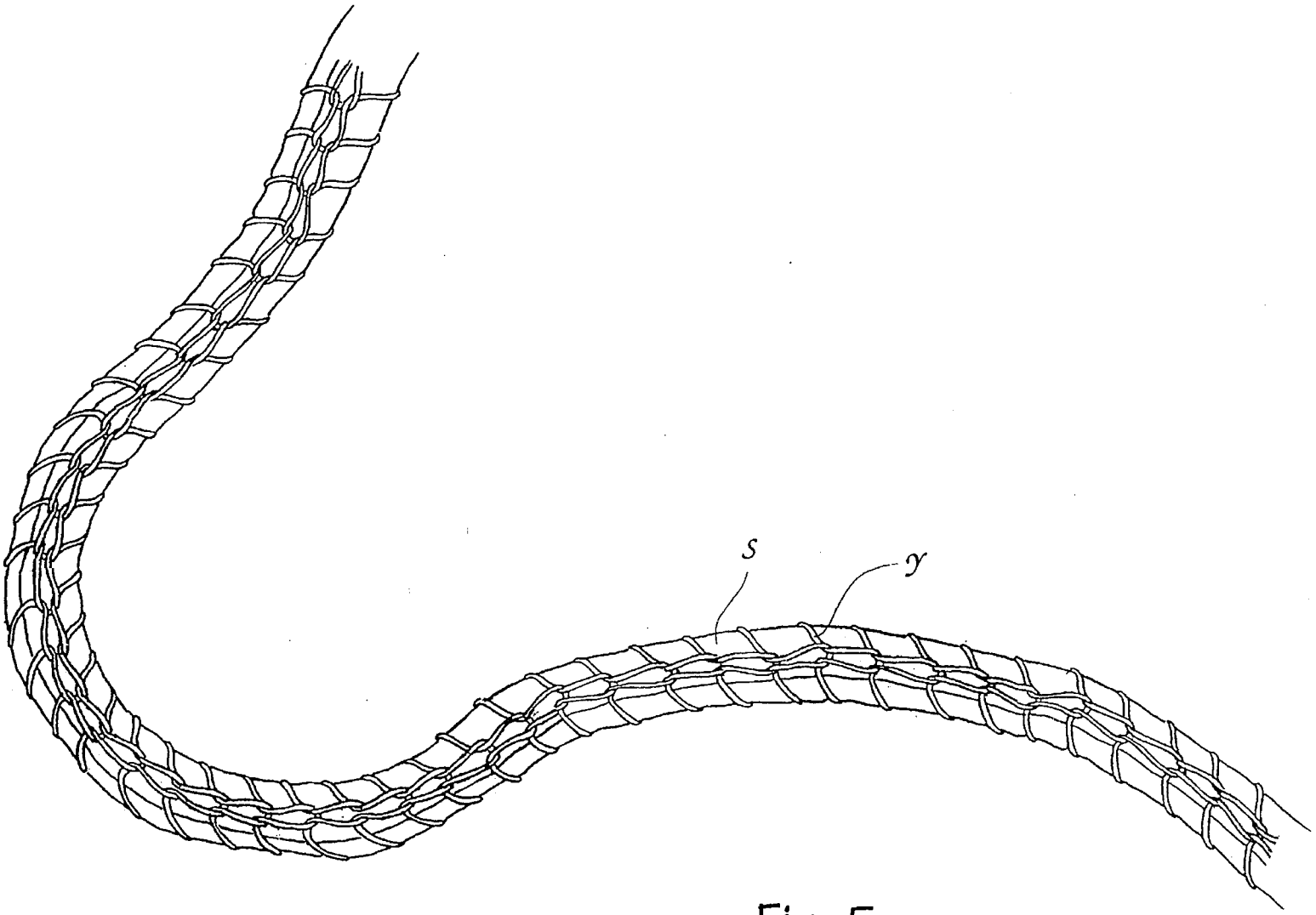
FIG. 5 is a perspective view of a decorative strand product produced by the present invention.

Since the yarn package support member 20 is freely rotatable with respect to the base 14, yarn is supplied to the knitting needles 32 at a rate based on needle generated demand. As the strand S is drawn through the strand conduit 30, the knitted pattern travels with the strand and the yarn is drawn to the knitting needles 32 by movement of the needles 32 themselves. Therefore, while the rotation of the base 14 drives the knitting needles 32 and positions the yarn circularly around the moving strand, the downward stroke of each needle 32 draws yarn from the yarn package which is supplied on needle generated demand from the yarn package by operation of the freely rotating yarn package support member 20. In that manner, a uniformly knitted pattern extends in a uniform openness along the length of the strand, resulting in the end product as illustrated in FIG. 5.

Optionally, and to enhance the decorative nature of the finished cord product in a surprisingly versatile manner, a textile fabric material F may be disposed intermediate the strand and the knitted yarn during the knitting operation. By selectively choosing the color, pattern or both of the textile material and the color of the yarn, the decorative appearance of the finished product may be enhanced. To that end, and with reference to FIG. 3, the aforesaid funnel 54 is positioned over the knitting assembly prior to fitting the strand S through the strand conduit 30. The funnel 30 may be supported by an operator's hand or by any other form of bracket suitable to position the funnel 54 above the knitting needles 32. To use the apparatus of the present invention in this manner, the strand is fed through the strand conduit 30 and into the drawing assembly 34 as previously described. Further, the yarn is threaded up on the knitting needles 32 as previously described. When the strand is traveling and the knitting operation is ongoing, the fabric F is fed into the cone of the funnel 54 and extends therethrough, closely adjacent the strand. Therefore, the yarn Y is knitted about the fabric F as well as the strand S with the fabric F intermediate the yarn Y and the strand S. In this manner, the decorative appearance of the finished product is enhanced.

By the above, the present invention provides a simple and easy to operate apparatus which will provide a decorative cord for use in crafts and other endeavors to provide rugs, trash cans and other decorative items. Further, the present invention may operate substantially unattended to produce large quantities of the decorative cord illustrated in FIG. 5 and usually needs to be attended only to change yarn packages.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for knitting about a traveling strand comprising:

a rotatable base member mounted to a support;

means for rotating said base member;

means for supporting a yarn package rotatably mounted to said base member for rotation independently from rotation of said base member;

a strand conduit mounted to the support concentrically with respect to said means for supporting a yarn package;

means for moving a strand through said strand conduit mounted to the support; and knitting means disposed adjacent said strand conduit for drawing yarn from a yarn package supported on said yarn package support means, and knitting the yarn about a strand traveling through said strand conduit, said knitting means being operable responsive to rotation of said base member.

2. An apparatus for knitting about a traveling strand according to claim 1 wherein said knitting means includes a plurality of knitting needles slidably mounted to said strand conduit and said base member includes at least one cam lobe disposed thereon for reciprocally driving said knitting needles as said base member is rotated.

3. An apparatus for knitting about a traveling strand according to claim 2 wherein said strand conduit includes an elongate tube having said knitting needles slidably mounted thereto, said tube being mounted to the support for rotation of said base member thereabout.

4. An apparatus for knitting about a traveling strand according to claim 3 wherein said yarn package support means includes a rotatable platform freely rotatably mounted to said base member for rotation about said tube.

5. An apparatus for knitting about a traveling strand according to claim 1 and further comprising means for directing yarn from said yarn package to said knitting means.

6. An apparatus for knitting about a traveling strand according to claim 5 wherein said yarn directing means includes an arm having a yarn opening formed in a distal end thereof, said arm being mounted to said base for rotation therewith and projecting therefrom for maintaining yarn from said yarn package oriented for knitting operations.

7. An apparatus for knitting about a traveling strand according to claim 6 wherein said yarn directing means includes a second arm mounted to said strand conduit for directing the yarn into said kintting means and for maintaining tension on said yarn cooperatively with said first arm, said second arm having an opening in the distal end thereof for the passage of yarn therethrough, with the first and second arms being mounted in alignment for the linear alignment of said yarn.

8. An apparatus for knitting about a traveling strand according to claim 1 wherein said strand moving means includes means for drawing the strand at a predetermined rate, said draw rate being proportional to the rotational rate of said base member.

9. An apparatus for knitting about a traveling strand according to claim 8 wherein said drawing means includes two adjacent cylinders selectively counter-rotatably driven for driving a strand disposed therebetween.

10. An apparatus for knitting about a traveling strand according to claim 9 wherein each of said cylinders includes a traction surface thereon having a relatively high coefficient of friction.

11. An apparatus for knitting about a traveling strand according to claim 1 and further comprising means to direct textile material to a disposition for being fixed intermediate the strand and the knitted yarn when the yarn is knitted about the strand.

12. An apparatus for knitting about a traveling strand according to claim 11 wherein said directing means includes a funnel for selective positioning generally concentrically around the strand at a position in advance of the knitting means with respect to a direction of strand movement for feeding textile material thereinto for positioning the textile material adjacent the strand for knitting the yarn about the strand with the textile material intermediate the strand and the knitted yarn.

13. An apparatus for knitting about a traveling strand comprising:

a rotatable base mounted to a frame;

means for rotating said base;

a rotatable yarn support platform mounted to said base for rotation independent of rotation of said base;

an elongate strand tube mounted to the frame for passage of a traveling strand therethrough, said strand tube being mounted concentrically with respect to said yarn support platform;

means for drawing the strand through said tube including two adjacent selectively counter-rotatable cylinders for engaging and drawing the strand therebetween, said drawing means being mounted to the frame adjacent an outlet of said strand tube for receiving the strand therefrom;

a knitting assembly including a plurality of knitting needles slidably mounted to said strand tube, and at least one cam lobe mounted to said base for reciprocatingly driving said knitting needles during rotation of said base; and an arm mounted to said base for rotation therewith for directing yarn from a yarn package disposed on said yarn support platform to said knitting needles for knitting about the strand, said knitting needles drawing yarn from the yarn package as needed to form a predetermined knitted pattern about the strand.

14. An apparatus for knitting about a traveling strand according to claim 13 and further comprising means to direct textile material to a disposition for being fixed intermediate the strand and the knitted yarn when the yarn is knitted about the strand.

15. An apparatus for knitting about a traveling strand according to claim 14 wherein said directing means includes a funnel for selective positioning generally concentrically around the strand at a position in advance of the knitting means with respect to a direction of strand movement for feeding textile material thereinto for positioning the textile material adjacent the strand for knitting the yarn about the strand with the textile material intermediate the strand and the knitted yarn.

* * * * *